United States Patent [19]

Morihara et al.

[11] Patent Number: 4,806,131

[45] Date of Patent: Feb. 21, 1989

[54] GASIFICATION PROCESS FOR COAL GASIFICATION FURNACE AND APPARATUS THEREFOR

[75] Inventors: Atsushi Morihara, Katsuta; Tomohiko Miyamoto, Takahagi; Shuntaro Koyama, Katsuta; Shunsuke Nogita; Yukio Hishinuma, both of Hitachi, all of Japan

[73] Assignee: Hitachi, Ltd., Tokyo, Japan

[21] Appl. No.: 36,433

[22] Filed: Apr. 9, 1987

[30] Foreign Application Priority Data

Apr. 9, 1986 [JP] Japan ..... 61-79932

[51] Int. Cl.[4] ..... C10J 3/46

[52] U.S. Cl. ..... 48/210; 48/203; 48/206; 48/DIG. 2

[58] Field of Search ..... 48/203, 206, 210, 69, 48/DIG. 2, DIG. 1; 110/165 R, 171, 347; 202/373

[56] References Cited

U.S. PATENT DOCUMENTS

| | | | |
|---|---|---|---|
| 1,146,627 | 7/1915 | Koppers | 48/DIG. 2 |
| 2,644,745 | 7/1953 | Hemminger | 48/DIG. 2 |
| 2,716,598 | 8/1955 | Moses | 48/DIG. 2 |
| 2,971,830 | 2/1961 | Kawai et al. | 48/206 |
| 4,180,387 | 12/1979 | Rudolph | 48/DIG. 2 |
| 4,445,441 | 5/1984 | Tanca | 48/DIG. 2 |
| 4,487,612 | 12/1984 | Hebden et al. . | |

FOREIGN PATENT DOCUMENTS

| | | | |
|---|---|---|---|
| 0050863 | 5/1982 | European Pat. Off. . | |
| 0066536 | 8/1982 | European Pat. Off. . | |
| 2749303 | 5/1978 | Fed. Rep. of Germany | 48/203 |
| 1207478 | 2/1960 | France . | |
| 2177089 | 2/1973 | France . | |
| 76302 | 7/1976 | Japan . | |
| 58703 | 5/1979 | Japan . | |
| 54-395 | 4/1980 | Japan . | |
| 194986 | 11/1983 | Japan . | |
| 0206489 | 11/1984 | Japan | 48/DIG. 2 |
| 232173 | 12/1984 | Japan . | |
| 2106130 | 4/1983 | United Kingdom | 48/206 |

*Primary Examiner*—Peter Kratz

*Attorney, Agent, or Firm*—Antonelli, Terry & Wands

[57] ABSTRACT

This invention relates to a gasification process for a coal gasification furnace in a coal gasification plant and to an apparatus therefor.

In particular, the invention relates to a gasification process for a coal gasification furnace which comprises ejecting coal and an oxidizing agent along the circumferential direction of a gasification chamber to form a whirling stream, making the two contact and react with each other in the gasification chamber, thereby producing a combustible gas from the coal while making ash in the coal melt into the form of slag, and withdrawing the slag through a slag tap provided at the lower part of the gasification chamber into a slag cooling chamber, wherein said process comprises causing the whirling stream to produce pressure difference such that the pressure decreases from the wall surface of the gasification chamber toward the central part thereof, forming, by use of the pressure difference, a recycle system wherein a part of the combustible gas produced is introduced from the gasification chamber to the slag cooling chamber and returned again therefrom to the gasification chamber, and heating the slag tag by means of the circulating combustible gas, and to a process therefor.

9 Claims, 9 Drawing Sheets

GASIFICATION PROCESS FOR COAL GASIFICATION FURNACE AND APPARATUS THEREFOR

FIELD OF THE INVENTION

This invention relates to a coal gasification plant. More particularly, it relates to a gasification process for a coal gasification furnace which process comprises supplying coal or other hydrocarbons along with an oxidizing agent to the coal gasification furnace, making them to react at a higher temperature and under a higher pressure, producing thereby a combustible gas while making ash in the coal to melt at the bottom part of the gasification furnace (the molten ash is hereinafter referred to as "slag"), and further providing a slag dropping device for dropping the slag into a quenching chamber positioned at a further lower part; and to an apparatus for the process.

BACKGROUND OF THE INVENTION

Although coal is a useful energy source with an abundant reserve, it is restricted in its field of application as compared with petroleum and natural gas because it is solid and has a high ash content. However, when coal is transformed into gas or liquid, it can be used in much wider fields of application and can he a more useful energy source. Accordingly, technologies for fluidizing coal are being developed in various countries.

Under such circumstances, particularly the combined coal gasification-power generation system is attracting attention as a power generation process for the next generation. The "combined coal gasificationpower generation system" is a system in which a combustible gas of high temperature is produced in a coal gasification furnace, steam is formed by recovering the sensible heat of the gas produced above, a steam turbine is driven by the steam formed, and concurrently a gas turbine is driven by the gasified combustible gas. This system can provide an improvement of several percent in power generation efficiency as compared with prior systems comprising a steam turbine alone. The coal gasification furnace is a principal component of the combined coal gasification-power generation system, and hence many companies are conducting the research and development of the furnace.

In coal gasification, attempts are being made to convert coal into gas in a high efficiency by use of such forms as a fixed bed, fluidized bed, and jet stream bed. An important problem for each form is how, during the gasification, to separate ash in the coal effectively from the produced gas and to remove the ash as a non-polluting substance from the gasification furnace.

A useful method for withdrawing ash in coal as a non-polluting substance comprises melting the ash, covering the surface of the ash with components contained in the ash itself and chaning the property of the surface into that of glass. Such a method of treating ash enables confinement of harmful metals contained in the coal ash within the ash particle. Thus, it is an effective method of treating ash from the viewpoint of environmental hygiene because no harmful metal is leached out of the ash with water etc. when the coal ash is employed, for example, in land reclamation. Further, this method of treatment can increase the density of ash several times in comparison with that of fly ash, which is the ash discharged from a prior thermal power generation boiler using pulverized coal, and hence can drastically decrease the volume of ash. Thus, it affords a great advantage in handling of ash. Accordingly, gasification furnaces using a fixed bed or jet stream bed mentioned above also adopt a structure wherein molten coal ash, namely slag, is stored in a slag tap positioned at the bottom of the furnace and is further dropped into a slag cooling chamber positioned below.

When the slag cannot be dropped stably from the slag tap to the slag cooling chamber, various problems occur. For example when the slag cannot be dropped stationarily, the ash in coal will scatter in large quantities into the downstream gas of the gasification furnace. In dust collectors, such as cyclones and bag filters, provided in the downstream, such problems as excessive differential pressure and clogging will take place owing to the intrusion of dust exceeding the design quantity. In the worst case, the emergency shut down of the gasification furnace becomes necessary owing to clogging of pipe lines.

Further, when the slag tap is clogged, slag will stay at the furnace bottom. If the operation of the furnace is still continued under such conditions, the slag will clog the outlet of the lower stage burner, inevitably resulting in stoppage of the operation. In order to start the operation again, it is necessary to dismantle the furnace, repair the furnace bottom part and replace the slag tap. In the worst case, the furnace becomes unrestorable.

Since coal is in general different in ash content and ash composition depending on the place of production, the melting temperature of the ash is also varied. Some ash melts at as low a temperature as about 1200° C. and some other does not melt even at 1600° C. or above.

Accordingly, it is one of the important problems for coal gasification to develop a furnace in which the stable dropping of molten slag is possible even when various kinds of coal with various ash compositions are used.

Regarding the slag tap, descriptions are found, for example, in Japanese Patent Application Kokai (Laid-open) Nos. 54,395/80 and 58,703/79. The former relates to the structure and material of a slag dropping part, and the latter relates to the structure of a burner used for heating the dropping part. These technologies aim at stable dropping of slag. The former is a method to be used for coal whose ash has a low melting point, and causes difficulty in dropping of ash having a high melting point. The latter method is effective also for ash of a high melting point because a heating burner is provided therein. In this method, however, the gas ring and the air ring of the heater provided at the dropping part are arranged in two stages and hence, in long time operation, they are subjected to thermal strain and the flame will deviate from the proper position for dropping the slag. Further, since the direction of gas flow and that of dropping slag is opposite, a smooth dropping is difficult to obtain. Further, in Japanese Patent Application Kokai (Laid-open) No. 76,506/82, the gasification furnace is constructed in multistage regarding the heating part as one furnace and heating in the furnace positioned under the slag tap is effected by use of a heavy oil of relatively low ash content.

The drawback of these methods lies in the use of a burner as an auxiliary heating means. Surely it is necessary to keep the slag dropping device at a temperature not lower than the melting point of slag in order to secure smooth dropping of the slag. For this purpose it is the most suitable to use a burner as an auxiliary heating means of high heat efficiency.

However, the auxiliary fuel to be used in heating the slag tap lower part should be an expensive, ash-free clean fuel, which is economically unadvantageous. Various studies have been made to obviate this defect. Resulting proposals mainly relate to fuels to be used. For example, the use of produced gas as the auxiliary fuel has been proposed. Since a coal gasification furnace produces by nature a combustible gas, the proposed method is effective because it needs no other fuel. However, in recycling the produced gas, the gas must be pressurized before being supplied to the gasification furnace, which results in complicating the apparatus. Further, since a high temperature gas is cooled and purified before use, heat loss is serious. An example of using coal itself as the auxiliary fuel has been proposed in Japanese Patent Application Kokai (Laid-open) No. 76,302/76. In this method, however, molten ash formed in the combustion of coal adheres to the lower part of the slag tap, causing an operational problem.

In any case, when a burner is provided, a fuel supply device, a control device etc. attendant thereon become necessary, making the system very complicated. Further, although recent gasification furnaces tend to aim at operation at higher pressures to increase efficiency or to increase capacity, many technical problems remain yet under high pressure conditions with regard the ignition and control of the burner. Burners to be used at high pressures are still in a developmental stage, and a reliable technology has not been established yet.

The ultimate form required for a slag tap is a slag tap heated by the heat of the furnace itself. When viewed from such a point, the hitherto proposed methods may be divided roughly into two groups. One is to heat the slag tap by passing the produced gas of high temperature in the furnace through the slag tap, namely the so-called downblow method. The other is to transfer the heat in the gasification furnace to the slag tap by means of heat transmission.

A typical example of heating the slag tap by passing the produced gas of high temperature in the furnace therethrough is found in a Texaco-type furnace. A "Texaco-type furnace" is a furnace in which the produced gas is withdrawn directly from the slag tap disposed at the bottom part of the gasification furnace. Accordingly, the clogging of the slag tap is not likely to occur. However, when the gas flow is downward, the relative velocity between the coal particles and the gasifying agent is small, resulting in a decreased gasification efficiency. Further, although it is essentially desirable at a slag tap to separate molten slag from produced gas and withdraw the slag alone, the total amount of the produced gas is withdrawn through the slag tap in this furnace and hence slag is entrained by the gas, resulting in poor efficiency in slag separation.

One example wherein the gas flow is upward and part of the produced gas is withdrawn from the slag tap is disclosed in Japanese Patent Application Kokai (Laid-open) No. 232,173/84. However, this method has a problem regarding the material of the pipe through which a high temperature gas is passed. Further, in order that a sufficient suction effect of an orifice may be obtained, the gas velocity at the furnace outlet should be 100 m/s or more, giving rise to fear of the abrasion of the material used in the furnace outlet part.

OBJECT OF THE INVENTION

This invention relates to such slag taps, and its object is, in the gasification of any kind of coal at any load, to effect smooth dropping of slag without using any additional heating means for preliminary heating.

SUMMARY OF THE INVENTION

The outline and the underlying principle of this invention will be described below. In order to keep slag in molten state during its dropping, the atmosphere in which the slag is dropped should be at a temperature sufficient to melt the slag, more particularly a temperature not lower than the melting point of ash in the coal. Accordingly, it is most desirable to bring the atmosphere gas in the furnace, in which the ash in the coal has already been molten into the form of slag, together with the slag out of the furnace and make them exist together until completion of dropping of the slag. In other words, the most desirable method of maintaining the slag tap temperature is to bring out a part of the high temperature gas in the furnace for slag dropping and then returning the gas rapidly into the furnace.

This invention has been accomplished to answer these problems. The principle underlying this invention, wherein the gas in the furnace is withdrawn together with slag through a slag tap and the withdrawn gas alone is returned into the furnace, will be described below.

Coal and an oxidizing agent are sprayed into a vessel of the form of a cylinder or the like having its axis in the vertical direction, to form a whirling stream centering around the axis. In a strong whirling stream in general the circumferential velocity is sufficiently high as compared with the radial and the axial velocity. In such cases the gas pressure distribution along the radial direction in the vessel is expressed by the following equation $$\frac{dP}{dr} = \rho \frac{V\theta^2}{r}$$

wherein P denotes pressure, $\rho$ gas density, $V\theta$ circumferential velocity, and r radius. Since in a whirling stream the centrifugal force applied to the fluid balances with the pressure as shown by the above equation, a negative pressure is formed near the center, effecting a large pressure difference between the center and the wall. This pressure difference is used to pass the high temperature gas in the surface through the slag tap.

A slag cooling chamber is provided under the above-mentioned vessel. The slag cooling chamber is made to communicate with the bottom parts of the vessel where a horizontal pressure difference has been effected by the whirling stream. Thus, the low pressure part, which is the point where the axis of the vessel intersects the bottom part of the furnace, is made to communicate with the slag cooling chamber to be used as the gas return hole. The high pressure part, which corresponds to a point nearer to the vessel wall than the gas return hole, is made to communicate with the slag cooling chamber to serve as the slag flow-down hole. Since the slag cooling chamber is in a region where no whirling stream exists, the pressure in the chamber is lower than that at the high pressure part in the vessel and is higher than that at the low pressure part in the vessel. In the communicating part, a gas flow is formed from the high pressure part to the low pressure part. Thus, the gas flows from the part where the pressure produced by the whirling stream is high to the region where no whirling stream is present, and the gas further flows from the region where no whirling stream is present to the central part where the pressure produced by the whirling stream is low. This principle is utilized to heat the slag tap by using the gas in the gasification furnace.

PREFERRED EMBODIMENTS OF THE INVENTION

Figure 3A:
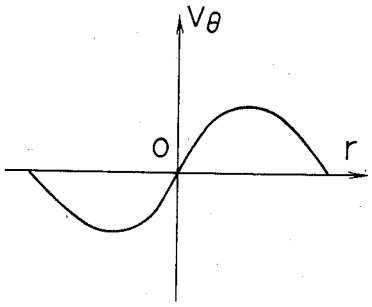
FIGS. 3(*a*), (*b*) and (*c*) are graphs and a drawing which show the principle of this invention.
Figure 3B:
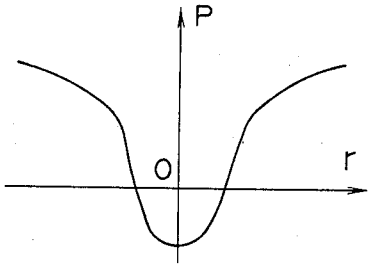
Figure 3C:
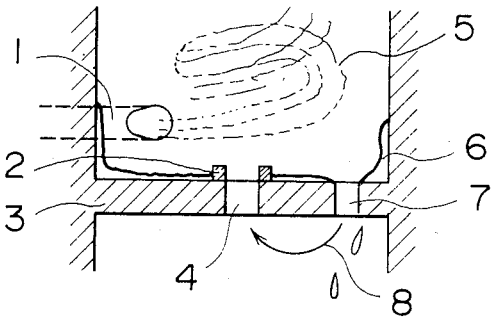

First, the fundamental principle of this invention will be described in detail below with reference to FIG. 3. FIG. 3(*a*) shows the distribution of the circumferential velocity ($V\theta$) in the gasification furnace versus the position in the direction of the radius (r). FIG. 3(*b*) shows the distribution of the pressure (P) in the gasification furnace versus the position in the direction of the radius (r). FIG. 3(*c*) is a schematic representation of the sectional view of the slag tap according to this invention.

In a whirling stream, the distribution of the circumferential velocity shows the maximum value at a specified position of the radius as shown in FIG. 3(*a*). Such velocity distribution is typical of the flow of a vortex in general. It compares a forced vortex and a free vortex in combination. The vicinity of the center of the whirling stream is the region of a forced vortex, where the radius and the velocity are in a proportional relation, the velocity increasing as the radius increases. On the other hand, the outer side of the whirling stream as against the center is the region of a free vortex, where the radius and the velocity are in an inversely proportional relation and the velocity decreases with the increase of the radius. Accordingly, as shown in FIG. 3(*a*), it shows a velocity distribution having the maximum at a specific position of the radius.

Then, the pressure distribution along the radial direction in such circumferential velocity distribution is shown in FIG. 3(*b*). Since the pressure balances with the centrifugal force resulting from the circumferential velocity, the pressure is higher at the outside than at the center. Accordingly, as shown in FIG. 3(*b*), the pressure distribution curve is downward convex at the center.

To form such pressure distribution in the radial direction, pulverized coal 5 and an oxidizing agent are ejected from a coal burner 1 provided in a tengential direction to the circumferential wall of the furnace, and a slag tap 3 shown in FIG. 3(*c*) is provided under the furnace. The slag tap 3 is provided with a slag flow-down hole 7 at the outer part of the whirl and with a gas return hole 4 at the center of the whirl. In this embodiment, the gas return hole 4 is provided with a weir or inclination 2 to assume a structure which does not allow slag 6 to drop. Under the slag tap 3, a pressure distribution uniform in the radial direction is developed because no whirling stream is formed there. As regards the comparison between the pressure above the slag tap 3 and the the pressure under the tap, the upper part pressure is lower than the lower part pressure in the gas return hole 4 positioned at the center of the whirl, whereas the upper part pressure is higher than the lower part pressure in the slag flow-down hole 7 positioned outside the center of the whirl. Consequently, gas flows upward in the gas return hole 4 at the center of the whirling stream and downward in the slag flow-down hole 7 at the outer side of the whirling stream. The high temperature gas in the furnace enters through the slag flow-down hole 7 into the lower side of the slag tap 3, and then returns again into the furnace through the gas return hole 4 as a gas stream 8.

The gas in the furnace is at a sufficiently high temperature to melt the slag 6. Accordingly, the gas emerging through the slag flow-down hole 7 to the outside of the furnace is also at a high temperature like in the furnace. When the gas passes through the slag flow-down hole 7, the heat possessed by the gas is transmitted to the slag flow-down hole 7 by convection or radiation and keeps the hole 7 at a sufficiently high temperature to melt the slag.

On the other hand, ash in the coal is molten by the heat in the furnace to form slag and entrained by the whirling gas stream, subjected thereby to a centrifugal force and moved toward the furnace wall. The furnace wall has already been wetted by molten slag 6. The slag 6 adheres to the furnace wall. When the slag reaches to a certain amount, it moves along the furnace wall to the slag tap 3 by gravity and then drops from the slag flow-down hole 7.

While the slag 6 drops by gravity, the gas stream goes toward the gas return hole 4. The slag 6 cannot follow the abrupt change of the gas flow direction, and thus separates from the gas stream and drops into the slag cooling chamber.

Thus, the circulation of a high temperature gas into the gasification furnace makes it possible to heat the slag flow-down hole 7 of the slag tap 3 at a temperature higher than the melting point of the slag and thereby to let the slag 6 flow down in a stable manner without using any auxiliary heating means.

Figure 1:
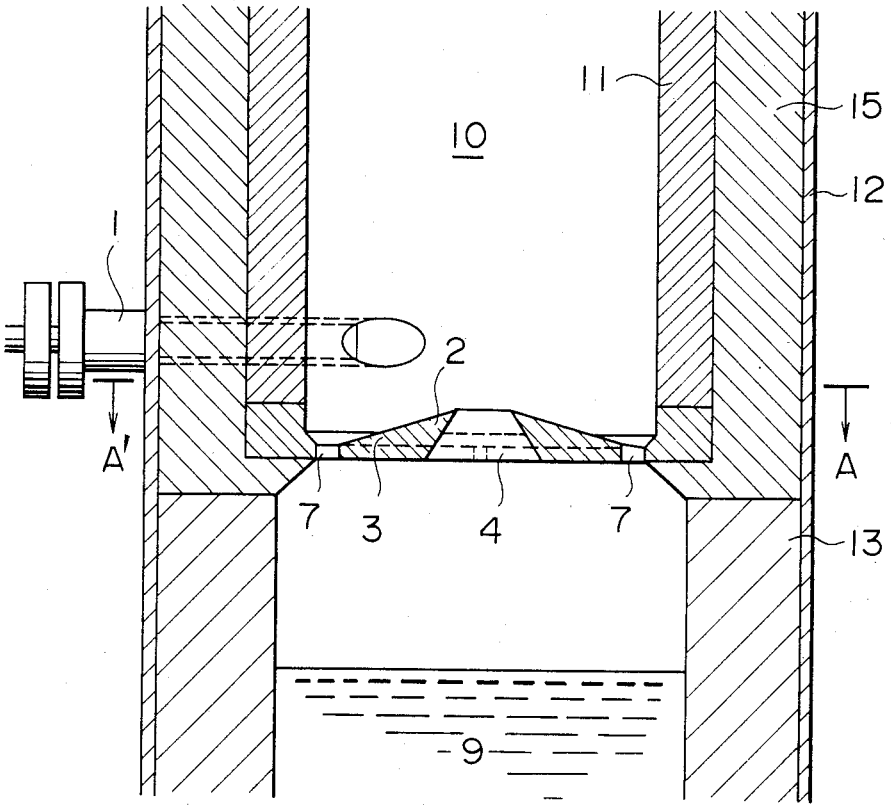
FIG. 1 is a longitudinal sectional view of Example 1 of this invention.
Figure 2:
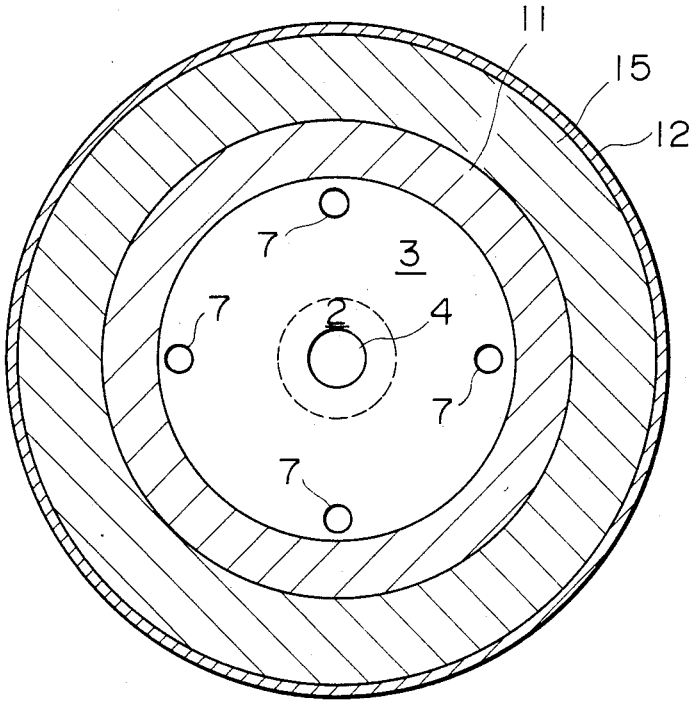
FIG. 2 is a cross-sectional view at the A—A' line of FIG. 1.

Hereunder, Example 1 of this invention will be described with reference to FIGS. 1, 2 and 3.

Figure 4:
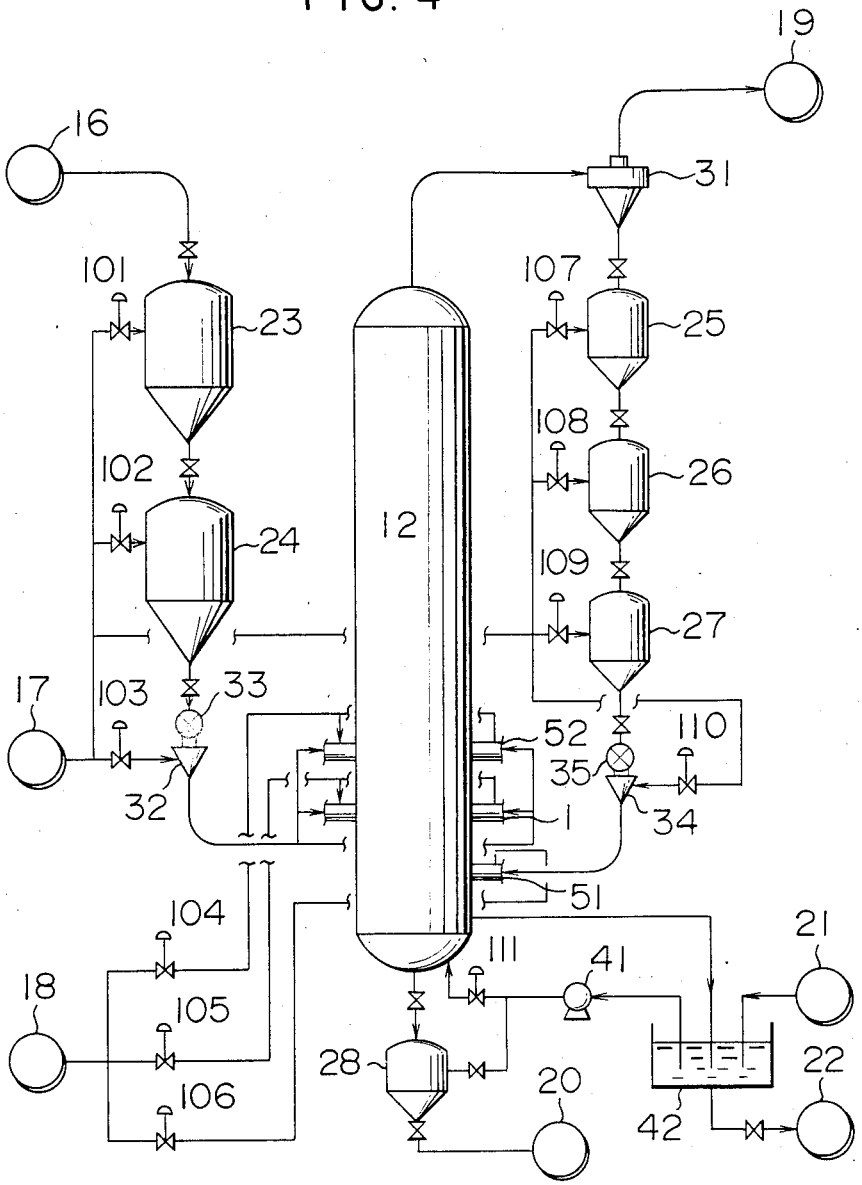
FIG. 4 is a schematic flow diagram of the gasification apparatus of this invention.

FIG. 4 is a schematic representation of the gasification apparatus of Example 1 of this invention. The whole system is composed of a coal supply part, a gasification furnace and a recycle apparatus.

The coal feed part is composed of a pressure hopper 23 for pulverized coal 16, a feed hopper 24 connected and opened just thereunder, a rotary feeder 33 provided at the lower part of the feed hopper 23, and an eductor 32. Their pressures are controlled by means of valves 101, 102 and 103. The eductor 32 is provided with a pipe line for supplying a carrier gas 17.

The coal gasification furnace 12 is provided with a lower stage coal burner 1, an upper stage coal burner 52 and a char burner 51. A gasifying agent 18 such as oxygen or air is also supplied simultaneously to each of these burners. The flow rate of the gasifying agent 18 is controlled with valves of 104 to 106. To the lower part of the coal gasification furnace 12 is connected the circulation apparatus for slag cooling water, and to the outlet at the upper part of the gasification furnace 12 is connected the recycle apparatus.

The circulation apparatus for slag cooling water is provided with a sump 42 to circulate water to the coal gasification furnace 12. Cooling water is stored in the sump 42, and is sent through a pump 41 and a valve 111 to the water tank of the coal gasification furnace 12. Further, a slag discharge hopper 28 is provided to withdraw the slag, discharged from the coal gasification furnace 12, to the outside, of atmospheric pressure, of the system. The slag is discharged as waste slag 20.

The recycle apparatus is composed of a cyclone 31 provided in the downstream of the coal gasification furnace 12, a cyclone hopper 25 to store collected char temporarily, a char pressure hopper 26 and a char feed hopper 27 provided right thereunder, a char rotary feeder 35 provided at the lower part of the char feed hopper 27, and a char eductor 34. Their pressures are controlled with valves 107, 108, 109 and 110. The char eductor 34 is provided with a pipe line to supply a carrier gas 17. To the outlet of the eductor 34 is connected a burner 51 for char. Numeral 19 indicates the produced gas from which the char has been separated at the cyclone 31.

The details of the inside of the coal gasification furnace 12 will be described with reference to FIGS. 1 and 2. FIG. 1 shows a longitudinal section of the coal gasification furnace. FIG. 2 shows a cross section taken at the A—A' line of FIG. 1. The gasification chamber 10 is surrounded with a refractory material 11 and further insulated with a heat insulating material 15. Since the lower part of the slag tap 3 is at a low temperature it is covered with a refractory material for low temperature service 13. The lower part of the slag tap 3 is also provided with a water tank 9. As shown in FIG. 2, the slag tap 3 is provided with a gas return hole 4 at the center and with a plurality of slag flow-down holes 7 around the former hole.

These holes are constructed such that the upper face of the gas return hole 4 is high as compared with the upper face of the slag flow-down hole 7, thus allowing no dropping of the slag. The coal burner 1 is provided in a direction tangential to the furnace.

Nextly, the operations in this invention will be described with reference to FIG. 4. The coal 16 pulverized to appropriate particle sizes is fed to the pressure hopper 23, then pressurized to a pressure higher than that of the coal gasification furnace 12 by means of the carrier gas 17 supplied through the valve 101, and sent to the feed hopper 24 already pressurized through the valve 102. The coal 16 is weighed at the rotary feeder 33, then mixed in the eductor 32 with the carrier gas 17 of a flow rate controlled with the valve 103, and sent to the upper stage coal burner 52 and the lower stage coal burner 1. The coal 16 and the gasifying agent 18 with a flow rate controlled with the valves 104 and 105 are ejected from the upper stage coal burner 52 and the lower stage coal burner 1 into the gasification furnace 12.

The coal 16 fed into the furnace contacts and reacts with oxygen or air of the gasifying agent 18 to produce heat and combustible gas of a high temperature. Since, particularly, the upper stage coal burner 52 and the lower stage coal burner 1 are provided in a direction tangential to the furnace, a strong whirling stream of gas is formed in the furnace, whereby the coal 16 and the gasifying agent 18 are well mixed and the reaction is promoted.

Ash contained in the coal 16 is molten by the high temperature atmosphere as well as by the heat produced by combustion of the coal 16 itself, to form slag. The slag is subjected to a centrifugal force caused by the whirling stream in the furnace and is adhered to the furnace wall. Then it moves along the furnace wall and reaches the slag tap 3 at the bottom of the furnace.

Further, operations in the gasification furnace 12 will be described with reference to FIG. 1.

It has been already described that since the pressure in the whirling stream balances with the centrifugal force caused by the circumferential velocity, it is higher at the outer part as compared with the center and shows a pressure distribution curve which is downward convex at the central part. Under the slag tap 3, a pressure distribution uniform in the radial direction is exhibited because no whirling stream is formed there. As regards the comparison between the pressure above the slag tap 3 and the pressure under the tap, the upper part pressure is lower than the lower part pressure in the central part of the whirl, whereas the upper part pressure is higher than the lower part pressure outside the center of the whirl. Consequently, gas flows upward in the gas return hole 4 positioned at the center of the whirling stream and downward in the slag flow-down hole 7 positioned at the outer side of the whirling stream.

The high temperature gas in the gasification chamber 10 passes through the slag tap 3 via the slag flow-down hole 7, enters under the slag tap 3 and then returns again through the gas return hole 4 into the gasification chamber 10. The gas in the gasification chamber 10 has a sufficiently high temperature to melt the slag. Accordingly, the gas emerging through the slag flow-down hole 7 to the outside of the gasification chamber 10 is also at a high temperature like in the gasification chamber 10. When the high temperature gas passes through the slag flow-down hole 7, the heat possessed by the gas is transmitted to the slag flow-down hole 7 by radiation or convection, and thus keeps the upper and the lower face of the slag flow-down hole 7 at a temperature sufficiently high to melt the slag.

The slag which has flowed down along the furnace wall is kept at a temperature sufficiently high for dropping of slag by the gas passing through the slag flow-down hole 7, and passes smoothly through the slag flow-down hole 7. Since the slag falls in drops by gravity, it separates from the gas stream and drops into the water tank 9 positioned at the lower part of the furnace. The high temperature gas from the furnace used for flowing down of the slag is returned again into the furnace through the gas return hole 4.

Thus, the slag flow-down hole 7 of the slag tap 3 can be heated to a high temperature not lower than the melting point of the slag and the slag can be made to flow down stably without using any auxiliary heating means.

Then, operations of the circulation apparatus for slag cooling water will be described with reference to FIG. 4. Cooling water is supplied continually through the pump 41 into the water tank 9 and is controlled by means of the valve 111 to maintain the temperature in the tank 9 below the evaporation temperature of water. The return water 22 which has reached a high temperature is either cooled and returned to the circulating water tank 42 or used as such as utility.

Since the slag is at a high temperature of 1000° C. or more, it is quenched when dropped into the water tank 9 of 100° C. or below. The slag develops cracks owing to the density difference caused by quenching and breaks into fragments to form water gramulated slag. The gramulated slag held in the water tank 9 is then collected in the slag hopper 28 by means of valve operation, then depressurized and discharged as waste slag 20.

Then, operations for the recycle apparatus is described with reference to FIG. 4. Char formed in the goal gasification furnace 12 is collected with the cyclone 31, then held in the cyclone hopper 25 provided right thereunder, and sent to the char rotary feeder 33 via the char pressure hopper 26 and the char feed hopper 27. The pressures in the cyclone hopper 25, the char pressure hopper 26, and the char feed hopper 27 are maintained by means of the carrier gas 17 supplied thereto controlled with valves 107, 108 and 109 such that the pressure of the cyclone hopper 25 is equal to that of the cyclone 31 and the pressures of the char pressure hopper 26 and the char feed hopper 27 are slightly higher than that of the gasification furnace 12. The char which has been made to a constant flow by means of the char rotary feeder 35 is mixed with the carrier gas 17 in the char eductor 34 and sent, together with a gasifying agent, through the char burner 51 to the coal gasification furnace 12 to be gasified again.

The gas circulation amount appropriate for flowing down of slag can be obtained by calculation.

As to the distribution of the circumferential gas velocity in the furnace, the following equation can be assumed from page 76 of "Uzugaku" (Vortex Science) (written by Akira Ogawa, published by Sankaido K.K., July, 1981)

$$V\theta = Va\frac{2ar}{a^2 + r^2}$$

wherein r denotes radius (m), $V\theta$ denotes circumferential velocity (m/s), a denotes turning radius (m), and Va denotes circumferential velocity (m/s) at the turning radius.

The relation between the ejection velocity of the coal burner and the gas circumferential velocity distribution can be obtained from angular momentum. The angular momentum in the furnace is expressed by the following equation $$G\phi = \int_0^R (rv\theta)\,\rho Vz2\pi r \cdot dr$$

wherein $G\phi$ denotes angular momentum ($kgm^2/s^2$), R denotes furnace radius (m), $\rho$ denotes gas density ($kg/m^3$), and $V_Z$ denotes axial velocity (m/s). Further, angular momentum supplied from the coal burner is expressed by the following equation.

$$Gz = a\Sigma(MiVi)$$

wherein Mi denotes the mass flow rate (kg/s) of component i, and Vi denotes the ejection velocity (m/s) of component i. The angular momentum is a conservative force and hence always assumes a constant value. Therefore, the following equation holds from the two equations shown above.

$$a\Sigma\,(MiVi) = \int_0^R (rv\theta)\,\rho Vz2\pi r \cdot dr$$

From the foregoing, $\rho$ and $V_Z$ are determined and then the gas velocity distribution can be expressed.

When the circumferential velocity is high as compared with the axial velocity, the following equation applies to the relation between the circumferential velocity distribution and the pressure distribution in the furnace.

$$\frac{dP}{dr} = \rho\frac{V\theta^2}{r}$$

The pressure distribution can be obtained by substituting the above-mentioned velocity distribution into the above equation, and then the pressure difference between the slag flow-down hole 7 and the gas return hole 4 can be obtained.

Then, the gas circulation amount will be calculated from the pressure distribution obtained above.

The shape of a self-heating type slag tap resembles that of an orifice. Accordingly, the method of calculating the pressure loss produced when a gas is passed through an orifice can be used to obtain the pressure loss produced when a gas is passed through the slag flow-down hole and the gas return hole of a self-heating type slag.

$$\Delta P = \zeta(s)\frac{\rho V^2}{2}$$

wherein $\zeta(s)$ denotes the drag coefficient (-). The coefficient $\zeta$ is a variable which varies depending on contraction ratio. Between the gas circulation amount Q and the pressure loss $\Delta P$, the following equation holds $$\Delta P = \frac{\rho Q^2}{2}\left(\zeta\left(\frac{S_1}{S_0}\right)\frac{1}{S_1^2} - \zeta\left(\frac{S_2}{S_0}\right)\frac{1}{S_2^2}\right),$$

wherein Q denotes the gas circulation amount ($Nm^3/h$), $S_0$ denotes the sectional area of the furnace ($m^2$), $S^1$ denotes the sectional area of the slag flow-down hole ($m^2$) and $S_2$ denotes the sectional area of the gas return hole ($m^2$).

The gas circulation amount can be calculated from the above equation by using the value of $\Delta P$ obtained above and $\zeta(s)$ obtained from the dimension of the slag tap.

Then, the method for controlling the temperature of the slag flow-down hole 7 of the slag tap 3 to a proper value when the temperature of the slag tap 3 varies as the result of, for example, the fluctuation of load in the coal gasification furnace 12 or the change of the kind of coal.

The gas temperature within the gasification furnace 12 is higher than the melting point of slag so long as coal is in molten state in the furnace. When the ash in the coal contacts with the gas, the ash will melt. Accordingly, in a self-heating type slag tap, the temperature of the slag flow-down hole 7 of the slag tap 3 is maintained higher than the melting point of the ash in the coal and the slag flows down through the slag flow-down hole 7 of the slag tap 3 so long as the ash in the coal is in a molten state.

However, even when the slag is flowing down stably, when, for example, the temperature in the furnace 10 decreases as the result of decreased load of the furnace, there is a possibility for the already molten slag to accumulate abruptly at the slag flow-down hole 7 even when the temperature in the furnace is still higher than the melting point of the slag. In such a case, it is possible that even when the temperature of the slag flow-down hole 7 is higher than the melting point of slag, it is not high enough to dispose of the slag completely and resultantly causes clogging at the slag flow-down hole 7.

Further, even when gasification is conducted with one and the same kind of coal, the property of the ash in the coal can change according to the lot of the coal. In such a case. the temperature of the slag flow-down hole 7 must be changed rapidly from the melting point of the already molten slag to that of the slag formed from the coal of new composition.

Aside from the above-mentioned cases in which the slag flow-down hole 7 is at so low a temperature as to begin clogging, another case is also unsuitable in which the temperature of the hole 7 is too high as compared with the slag flow-down temperature, thus increasing heat loss and decreasing gasification efficiency. Accordingly, it is the most suitable to keep the slag flow-down hole 7 at a temperature as low as possible but higher than the slag melting temperature.

According to this invention, the temperature of the slag flow-down hole 7 is maintained higher than the slag flow-down temperature by passing the gas from the gasification chamber 10 through the slag flow-down hole 7 of the slag tap 3. Accordingly, in order to increase the temperature of the slag flow-down hole 7, it is necessary either to increase the quantity of the high temperature gas passed through the slag flow-down hole 7 or to increase the temperature of the high temperature gas further. On the other hand, to decrease the temperature of the slag flow-down hole 7, it is necessary either to decrease the quantity of the high temperature gas passed through the slag flow-down hole 7 or to lower the temperature of the high temperature gas.

In such cases, according to this invention, the temperature of the slag flow-down hole 7 can be easily controlled merely by increasing or decreasing the amount of oxygen of the lower stage coal burner 1.

The oxygen nozzle diameter of the lower stage coal burner 1 is, when the gasification furnace is in operation, generally a constant value. Accordingly, the oxygen ejection velocity increases when the oxygen feed amount is increased. When the oxygen ejection velocity is further increased, the whirling stream in the whole furnace is strengthened, the pressure difference between the center of the whirling stream and the vicinity of the wall is increased, and the circulating amount of the high temperature gas passed through the slag flow-down hole 7 is increased. Further, when the oxygen feed amount is increased in the lower stage coal burner 1, the oxygen ratio increases and the temperature of the produced gas increases.

The synergistic effect of the two factors mentioned above makes it possible to increase the temperature of the slag flow-down hole 7 immediately by increasing the oxygen feed amount at the lower stage coal burner 1 and to lower the temperature of the slag flow-down hole 7 immediately by decreasing the oxygen feed amount for the lower stage coal burner 1. Thus, the temperature of the slag flow-down hole 7 can be controlled as desired merely by increasing or decreasing the oxygen feed amount for the lower stage coal burner 1.

Figure 5:
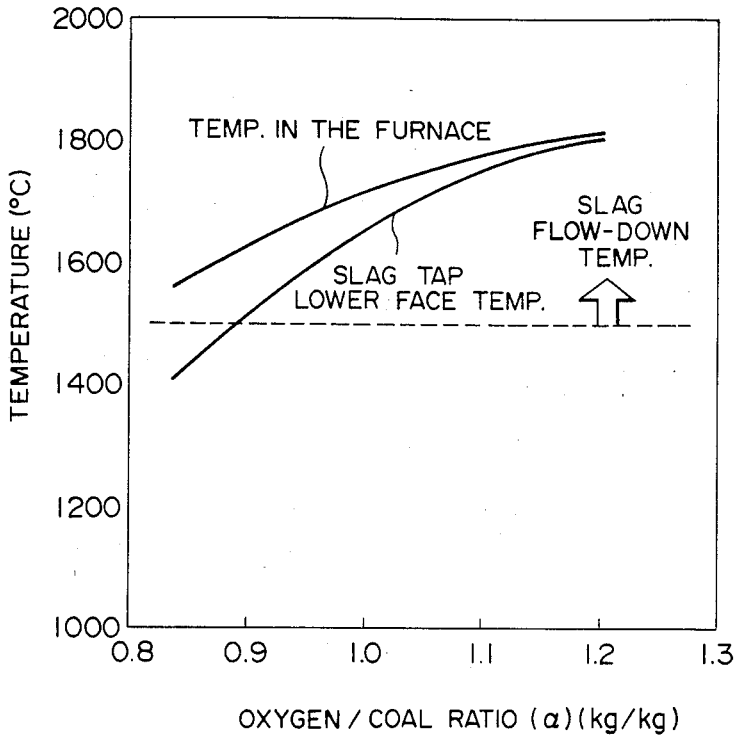
FIG. 5 is a diagram showing the result of temperature control conducted in Example 1 of this invention.

FIG. 5 shows the result of temperature control of the slag tap 3 conducted in the present Example. In the Figure, the abscissa indicates the ratio ($\alpha$) of the oxygen feed amount to the coal feed amount, and the ordinate indicates the temperature of the slag flow-down hole 7. The increase of $\alpha$ leads to the increase of the temperature in the furnace and also to the increase of the temperature of the slag flow-down hole 7. Further, with the increase of $\alpha$, the temperature of the slag flow-down hole 7 approaches the temperature in the furnace. This is because since the amount of circulating gas passing through the slag flow-down hole 7 increases with the increase of $\alpha$, heat transmission from the high temperature gas to the slag flow-down hole 7 is promoted.

Thus, the result described above shows that the temperature of the slag flow-down hole 7 can be controlled as desired merely by increasing or decreasing the oxygen feed amount, and that this invention is effective also in the situations described above.

Next, Example 2 of this invention will be described with reference to FIGS. 6 and 7.

Figure 6:
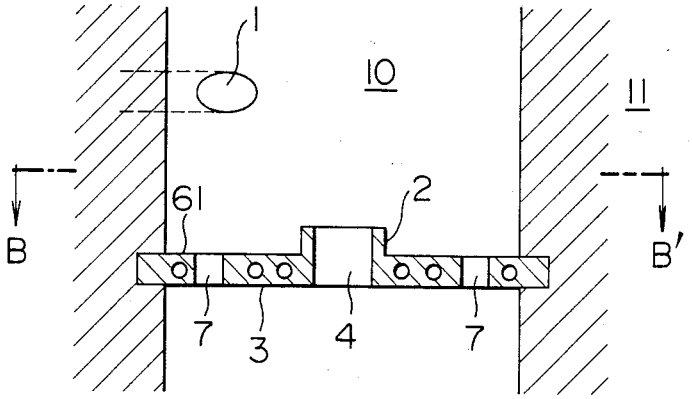
FIG. 6 is a longitudinal sectional view of Example 2 of this invention.

FIG. 6 shows a longitudinal sectional view of a gasification furnace at the slag tap portion. FIG. 7 shows a cross-sectional view thereof at the B—B′ line. The fundamental principle is the same as that in Example 1 described above. Structural difference from Example 1 consists of two points: the slag tap 3 has a water cooled structure wherein a water cooling tube 61 is provided inside the slag tap 3 to cool the slag tap 3; and a weir 2 is provided around the gas return hole 4 instead of an inclination.

The slag tap 3 is not merely exposed to the high temperature of the inside of the gasification furnace; molten slag of high temperature always flows along its surface. Since slag is in the form of liquid, is rich in reactivity and is a mixture of many components, it has a high affinity for substances containing the constitents of the slag. Materials used for the slag tap 3 are generally metal oxides such as silica and alumina. Since these metal oxides are all contained in the ash of coal, the slag tap 3 and the slag have a very high affinity for each other, and hence the slag tap 3 is apt to be damaged by slag through erosion and wetting.

Figure 7:
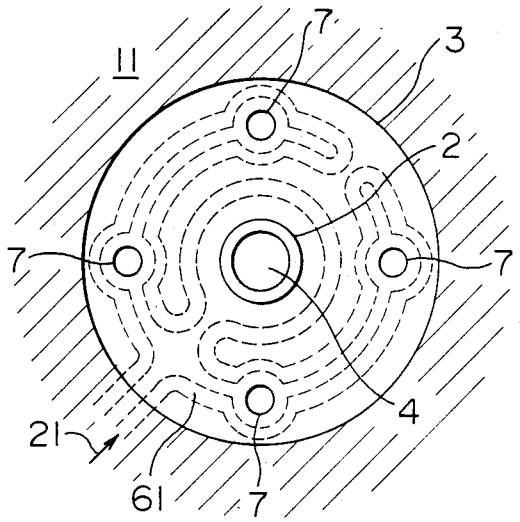
FIG. 7 is a cross-sectional view at the B—B' line of FIG. 6.

In Example 2, therefore, a water-cooling tube 61 is provided within the slag tap 3 around the slag flow-down hole 7 and the gas return hole 4 as shown in FIG. 7. Water 21 is circulated inside the water cooling tube 61 to cool the surface of the water cooling tube 61 and thereby to cool the slag tap 3. By this means, the surface temperature of the slag tap 3 is maintained low, whereby the reaction of the tap surface with slag is suppressed and at the same time part of the slag is solidified at the surface of the slag tap 3; the solidified slag protects the surface of the slag tap 3, and this self-coating suppresses the erosion of the surface of the slag tap 3.

The present Example has the effect of increasing the life of the slag tap 3 and simultaneously improving its reliability.

The second point of difference, the weir 2, will be described below. In Example 1, an inclination was provided around the gas return hole 4 so as not to allow the slag to flow down therethrough. However, with the increase of throughput of the gasifier 12 the inner diameter of the gasification furnace needs to be increased, and resultantly cases are expected wherein it becomes structurally difficult to provide an inclination over the whole of the bottom of the gasification furnace. In such cases, a weir 2 as shown in Example 2 can be manufactured relatively easily. The weir 2 should have a height such that the upper part of the weir 2 may protrude sufficiently relative to the amount of slag which stays at the bottom of the gasification chamber 10 and at the same time it may not be destroyed by being exposed to high temperature of the flame in the gasification chamber 10.

The effect of this Example is the ease of manufacture.

Then, Example 3 will be described with reference to FIGS. 8 and 9.

Figure 8:
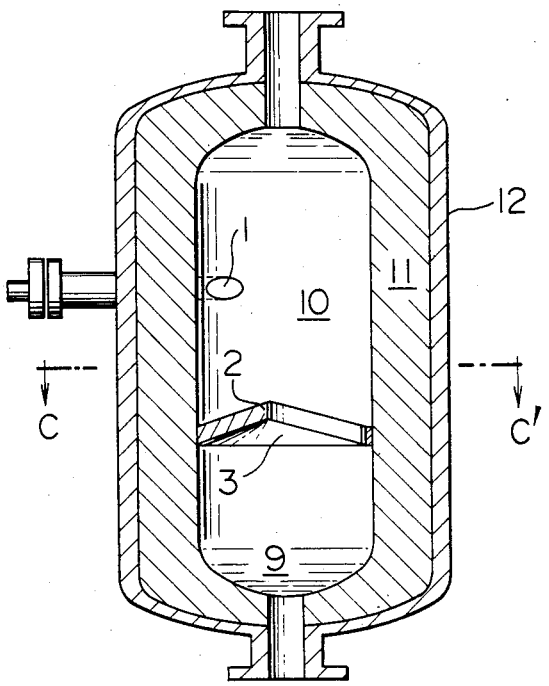
FIG. 8 is a longitudinal sectional view of Example 3 of this invention.
Figure 9:
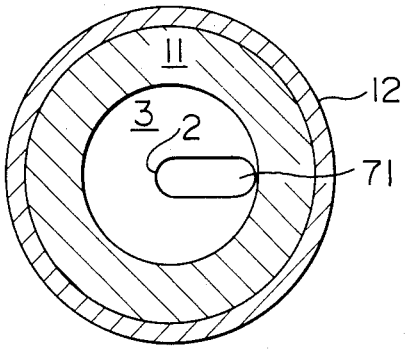
FIG. 9 is a cross-sectional view at the C—C' line of FIG. 8.

FIG. 8 shows a longitudinal sectional view of Example 3. FIG. 9 shows a sectional view thereof at the c—c' line. The fundamental principle is the same as in Example 1. Structural difference from Example 1 is that the slag flow-down hole 7 and the gas return hole 4 were not differentiated and a slag-gas communicating hole 71 which has both of the effects of the two was newly provided.

The slag-gas communicating hole 71 is a hole which continues from the center to the wall of the gasification furnace. In the neighborhood of the wall it plays the role of the slag flow-down hole 7 of Example 1, whereas at the central part it plays the role of the gas return hole 4. Thus, the central part is made to be higher than the horizontal plane of the slag tap 3, so that the slag does not flow down therethrough. The high temperature gas in the furnace moves, through the part of the slag-gas communicating hole 71 which is near the wall, from the gasification chamber 10 to the slag cooling chamber, and returns to the gasification chamber 10 through the part of the slag-gas communicating hole 71 which is near the center. Thus, the slag-gas communicating hole 71 can be kept at a higher temperature than the slag flow-down temperature by means of the high temperature gas in the furnace, whereby the slag can be made to flow down stably.

The effect of this Example is that the slag tap 3 can be manufactured with ease because the slag tap 3 needs to be provided with the slag-gas communicating hole 71 alone instead of a plurality of holes.

Next, Example 4 will be described below with reference to FIGS. 10 and 11.

Figure 10:
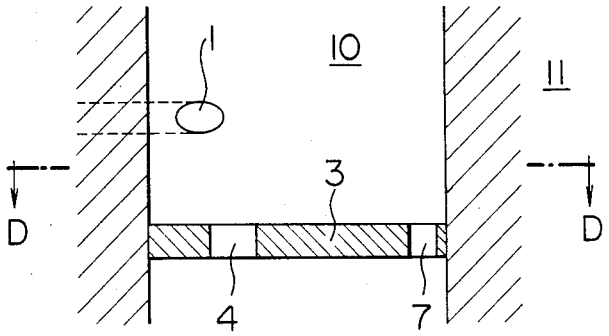
FIG. 10 is a transverse sectional view of Example 4 of this invention.
Figure 11:
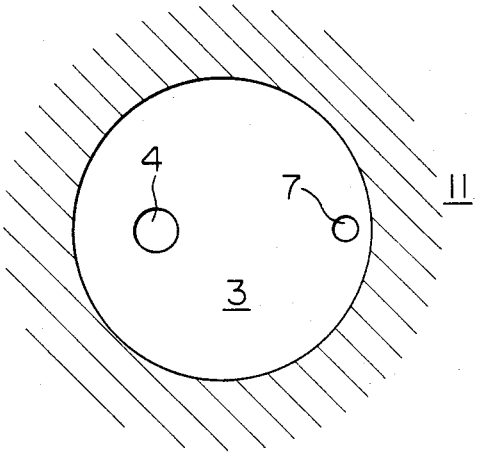
FIG. 11 is a cross-sectional view at the D—D' line of FIG. 10.

FIG. 10 shows a longitudinal sectional view of Example 4. FIG. 11 shows a cross-sectional view thereof at the D—D' line. The fundamental principle is the same as in Example 1. Structural difference from Example 1 lies in that the gas return hole 4 is provided outside the extension line of the axis of the gasification furnace 12 and that no weir or inclination 2 is provided around the gas return hole 4 and the upper face of the gas return valve 4 is made to be on the same level as that of the upper face of the slag flow-down hole 7.

In the whirling stream within the furnace, the largest pressure difference can be obtained between the center and the wall. However, in manufacturing the slag tap 3, sometimes the gas return hole 4 cannot be provided at its central part owing, for example, to the problem of the arrangement of the water cooling pipe 61. However, when the gas return hole 4 and the slag flow-down hole 7 are provided at different distances from the center, a certain extent of pressure difference can be obtained. Accordingly, also when the gas return hole 4 is provided outside the extension of the axis of the gasification furnace 12, some pressure difference is produced, and resultantly gas circulation stream can be formed and the slag flow-down hole 7 can be maintained at a temperature not lower than the temperature necessary for stable flowing down of slag.

When a weir or inclination 2 is not provided around the gas return hole 4, slag would flow down from the gas return hole 4. However, through the gas return hole 4, gas flows from the slag cooling chamber to the gasification chamber 10. Thus, a strong upflow is formed in the gas return hole 4, whereby the slag can be prevented from flowing down. Accordingly, the same effect can be attained as that obtained in providing a weir or inclination 2.

The effect of this Example is that the slag tap 3 can be manufactured with more ease because the gas return hole 4 can be provided at any desired position of the slag tap 3 and the weir or inclination 2 needs not to be provided.

Further, assuming a case wherein the technology of producing ceramics is further improved in future to enable the manufacture of a structure of a complicated form as the slag tap 3, Example 5 will be described below with reference to FIGS. 12, 13 and 14.

Figure 12:
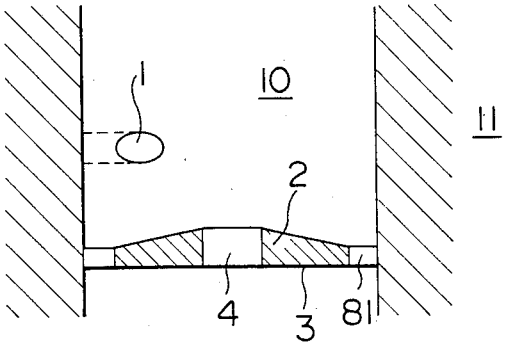
FIG. 12 is a transverse sectional view of Example 5 of this invention.

FIG. 12 shows a longitudinal sectional view of the furnace of Example 5. FIG. 13 shows a side view of the slag tap 3 of Example 5. FIG. 14 shows a top view of the slag tap 3 of Example 5. The fundamental principle is the same as in Example 1. The structural differences from Example 1 lie in that the slag flow-down hole 7 of the slag tap 3 was made in the form of fins thereby to increase the gas circulation amount and that radiation from the gasification furnace 10 to the water tank 9 through the slag flow-down hole 7 was suppressed.

Figure 13:
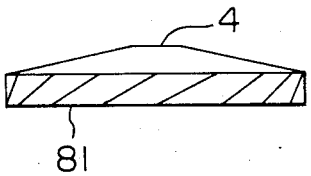
FIG. 13 is a side view of the slag tap of FIG. 12.
Figure 14:
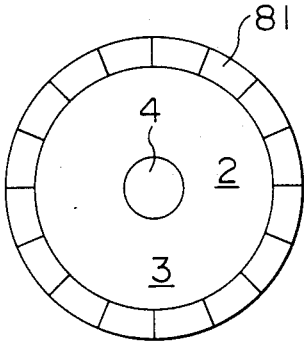
FIG. 14 is a top view of the slag tap of FIG. 13.

As shown in FIGS. 13 and 14, although the gas return hole 4 is similar to that in Example 1, the slag flow-down hole 7 is in the form of fins. The inclination of the fins 81 is provided such that the whirling stream in the gasification chamber 10 causes the gas in the furnace to move downward. This makes it possible to move the gas in the furnace to the slag cooling chamber even with a slight whirling stream. Further, the fins 81 can be placed one upon another leaving no gap therebetween, whereby radiation from the gasification furnace 10 to the water tank 9 through the slag flow-down hole 7 can be suppressed.

The effects of this Example are that since the gas circulation amount can be increased, the sizes of the slag flow-down hole 7 and the gas return hole 4 can be reduced and that since radiation from the gasification furnace 10 to the water tank 9 through the slag flow-down hole 7 can be suppressed, heat dissipation to the water tank 9 can be reduced.

EFFECT OF THE INVENTION

According to this invention the temperature of the slag tap can be maintained at the slag flow-down temperature by utilizing the pressure difference present in the gasification chamber without providing any additional heating means for preliminary heating and resultantly the slag can be dropped smoothly.

What is claimed is:

1. A coal gasification process comprising the steps of:

ejecting coal and an oxidizing agent into a gasification chamber of a furnace in such a manner that a whirling stream is formed of the coal and oxidizing agent, thereby producing a combustible gas from the coal while ash present in the coal melts to form a slag;

causing the whirling stream to produce a pressure differential in the gasification chamber such that pressure decreases from wall surfaces of the gasification chamber to a center of the gasification chamber, the pressure near the wall surfaces of the gasification chamber being greater than pressure in a slag cooling chamber of the furnace, and the pressure near the center of the gasification chamber being less that the pressure in the slag cooling chamber;

passing a portion of the combustible gas and slag through at least one slag flow-down hole formed through a slag tap, which separates the gasification chamber from the slag cooling chamber, the at least one slag flow-down hole being formed near the wall surface of the gasification chamber, and returning the combustible gas from the slag cooling chamber to the gasification chamber through a gas return hole formed through the slag trap near the center of the gasification chamber, wherein the portion of the combustible gas and slag pass through the at least one slag flow-down hole because of the pressure difference between the slag cooling chamber and the gasification chamber near the wall surface, and the combustible gas returns through the gas return hole because of the pressure difference between the slag cooling chamber and the gasification chamber near the center.

2. A coal gasification process according to claim 1, wherein the amount of gas recirculating between the gasification chamber and the slag cooling chamber is controlled by controlling the ejection velocity of the oxidizing agent.

3. A coal gasification process according to claim 1, wherein a temperature of the combustible gas is controlled by controlling the feed amount of the oxidizing agent.

4. A coal gasification process according to claim 1, wherein a temperature of the slag trap is controlled by controlling the ratio of the feed amount of the oxidizing agent to the feed amount of the coal.

5. A coal gasification process according to claim 1, wherein the slag flow-down hole and gas return hole are formed as a single hole.

6. A coal gasification process according to claim 1, wherein the gas return hole is formed to have a height higher than that of the slag flow-down hole.

7. A coal gasification process according to claim 1, further including the step of cooling the slag tap by providing a cooling tube around the slag flow-down hole and the gas return hole.

8. A coal gasification process according to claim 1, wherein the gas return hole is formed outside an extension line of an axis of the furnace, and is formed to be on the same level with the slag flow-down hole.

9. A coal gasification process according to claim 1, wherein the slag flow-down hole is made in the form of fins having an inclination which allows gas in the furnace to move downward because of the whirling stream in the gasification chamber.

* * * * *